US005105597A

United States Patent [19]

Wilkening

[11] Patent Number: 5,105,597

[45] Date of Patent: Apr. 21, 1992

[54] DOOR CONSTRUCTION

[75] Inventor: Steven R. Wilkening, Grand Rapids, Mich.

[73] Assignee: ODL, Incorporated, Zeeland, Mich.

[21] Appl. No.: 604,136

[22] Filed: Oct. 29, 1990

[51] Int. Cl.[5] ..... E06B 3/58; E06B 3/70

[52] U.S. Cl. ..... 52/455

[58] Field of Search ..... 52/455–459, 52/802, 803, 804, 808; 49/501, 504

[56] References Cited

U.S. PATENT DOCUMENTS

| | | | |
|---|---|---|---|
| 2,582,467 | 1/1952 | Sylvan | 49/501 |
| 3,599,703 | 8/1971 | Mennuto | 52/802 |
| 3,760,543 | 9/1973 | McAllister | 52/455 |
| 3,903,669 | 9/1975 | Pease et al. | 52/455 |
| 4,327,535 | 4/1983 | Governale | 52/309.11 |
| 4,706,431 | 11/1987 | Corvese | 52/313 |
| 4,947,597 | 8/1990 | Simpson | 52/458 |

*Primary Examiner*—James L. Ridgill, Jr.
*Attorney, Agent, or Firm*—Warner, Norcross & Judd

[57] ABSTRACT

A door construction is disclosed having a peripheral frame, a glazing panel, and front and rear unitary facings, each facing having an upper door light casing portion and a lower door plant panel portion. The facings are placed back-to-back over a single, central opening in the frame, clamping the frame and glazing panel between the edges of the facings. The door thus constructed has the appearance of traditional woodwork and avoids the alignment and parts inventory problems of the prior art.

13 Claims, 3 Drawing Sheets

DOOR CONSTRUCTION

BACKGROUND OF THE INVENTION

1. Field of the Invention

The present invention relates to doors, and, more particularly, to a door construction having unitary facings which provide both a door light and a door plant.

2. Description of the Related Art

It is known in the art to construct an architectural door as an assembly of prefabricated parts. Such constructions are used to take advantage of the economy, strength, and weather resistance of modern materials, but still provide the attractive appearance of traditional woodwork.

One frequently desired style of door is configured with a glazed window, known as a "light", in the upper portion of the door, and a decorative panel, known as a "plant", in the lower portion. A typical prior art construction for such a door is shown in FIG. 7. According to this construction, the door is an assembly of six components: a door frame F, glazing G, front and rear light casings C, C', and front and rear plant panels P, P'. The frame is provided with a rail R which divides the frame into an upper opening and a lower opening. When assembled, the glazing is installed in the upper opening sandwiched, along with the upper portion of the frame, between the casings C, C'. The plant panels P, P' are installed back-to-back in the lower opening of the frame. Screws are inserted through holes H in the rear casing C' and rear plant panel P' and into corresponding pilot holes in the rear surfaces of the front casing C and front plant panel P. Hardware such as handles, hinges and a lock set are installed in the frame. The assembled door has the finished appearance of a traditional wood construction, even though synthetic materials such as molded plastic may be used for the casings and plant panels.

The prior art door construction as described above has several drawbacks. First, a relatively high number of components are required, including two casings and two plant panels. This requires additional inventory, handling, and the exercise of additional care to make sure that the design styles of the casings and plant panels match. Second, a special door frame having two holes and intermediate rail is required, also adding to inventory and handling requirements. Third, steps must be taken to ensure that the two frame openings, the casings and the plant panels are in alignment with each other and with the door frame. Fourth, since the assembled door is structurally divided into upper and lower zones in which the casings and plant panels may shift relative to one another, the door is susceptible to distortion, such as might be induced by racking forces.

Thus, there is an unmet need for a door construction having a light and a plant panel which has a minimal number of components, which is easily manufactured and assembled into proper alignment, and which is structurally strong and rigid.

SUMMARY OF THE INVENTION

The present invention meets the above mentioned need by providing a door construction having integral light casing and plant panel components. In the preferred embodiment, the casing and plant panel are formed together as a unitary facing of molded plastic material. The lower portion of the facing comprises a plant panel and, if desired, a simulated rail. Extending upwardly from the lower portion of the facing are two casing side elements. A casing upper element extends between the upper ends of the two casing side elements. The upper edge of the lower portion of the facing forms the lower element of the casing.

The door frame is formed with a single opening into which fit front and rear facings, disposed back-to-back. Glazing is installed in the light of the door, sandwiched between the front and rear facings. The assembly is held together by screws spaced around the outer perimeter of the facing and along the lower element of the casing. Tightening of the screws causes the door frame and glazing to be clamped between the front and rear facings.

The resulting door construction is strong and rigid due to the use of integral facings, there being no possibility of shifting between the upper and lower portions of the door. Only a single hole in the door frame is required, and the number of door components is reduced to a minimum. Misalignment between the light and the plant is eliminated. Fewer screws or other fasteners are needed to assemble the door, and it is impossible to mismatch the casings and the plant panels. The door frames are also suitable for use with other door constructions such as those having a top-to-bottom light, thus further reducing parts inventories.

These and other objects, advantages, and features of the present invention will be more fully understood and appreciated by reference to the written specification and appended drawings.

DESCRIPTION OF THE PREFERRED EMBODIMENT

Figure 1:
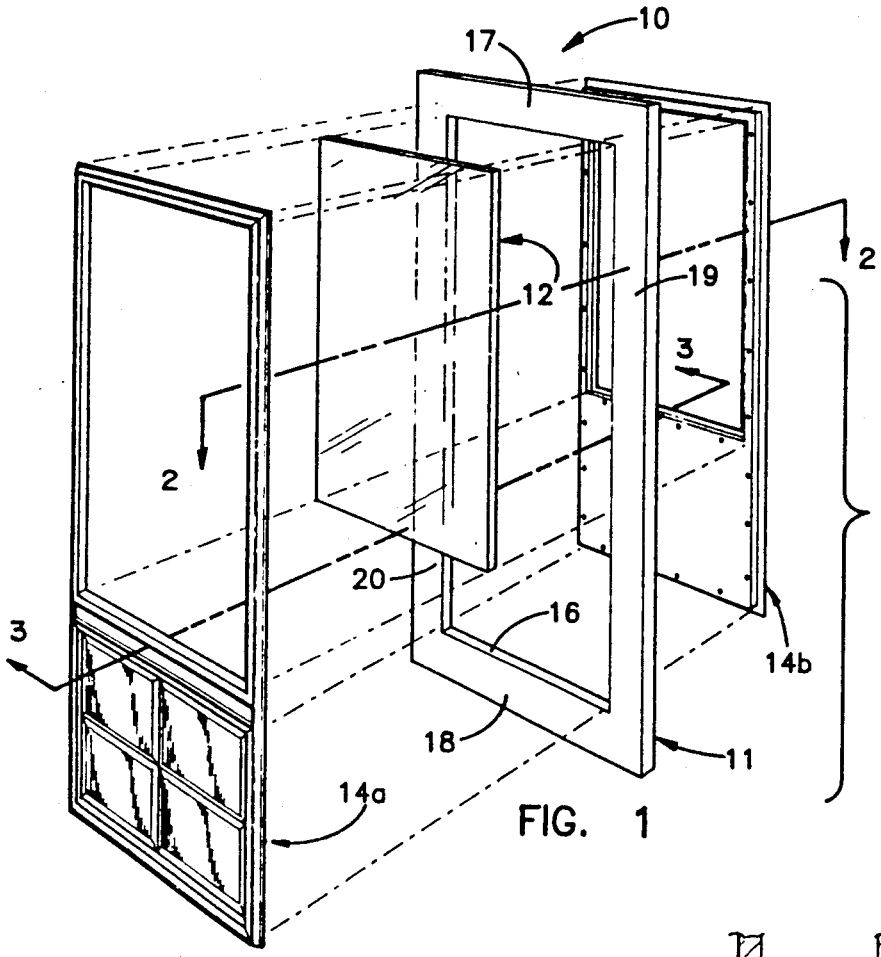
FIG. 1 is an exploded perspective view of a door construction according to the principles of the invention.

By way of disclosing a preferred embodiment, and not by way of limitation, there is shown in FIG. 1 a door construction 10 which includes in its general organization a frame 11, glazing panel 12, front facing panel **14*a*, and rear facing 14*b***.

Figure 2:
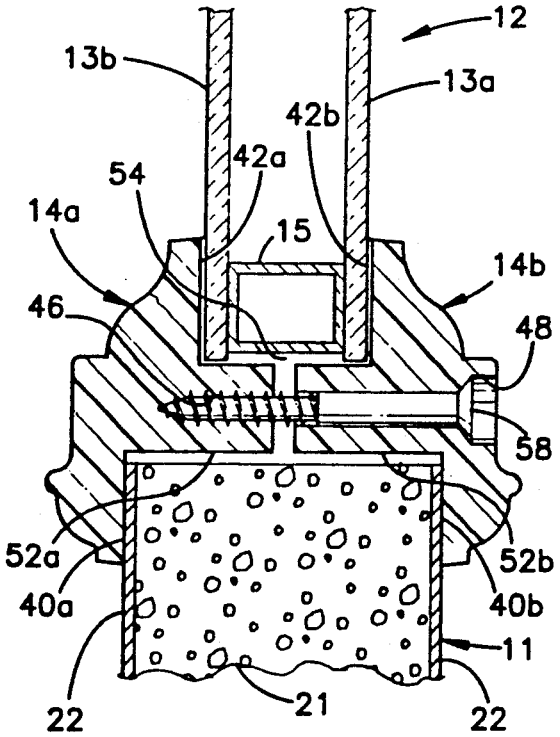
FIG. 2 is a sectional view, taken as indicated by the line 2—2 of FIG. 1, of an assembled door.

The door frame 10 is a rectangular panel having a single, central hole or opening 16 surrounded by spaced apart, parallel, generally horizontally extending top and bottom frame portions 17, 18, and spaced apart, parallel, generally vertically extending side portions 19, 20. As those skilled in the art will appreciate, the frame 10 may be formed from a single piece, or an assembly of pieces, of material such as natural wood. Often, however, the frame 10 will be of manufactured materials such as hardboard, particle board, corrugated paperboard, or of composites thereof. As shown in FIG. 2, the frame may also be constructed as a core 21 covered by veneers 22 of materials such as sheet metal for strength or natural wood for appearance.

Figure 3:
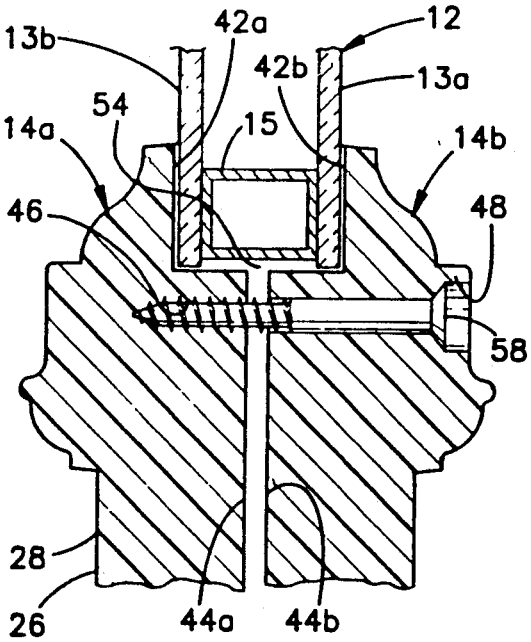
FIG. 3 is a sectional view, taken as indicated by the line 3—3 of FIG. 1, of an assembled door.

Glazing panel 12 is constructed in a known manner, as best shown in FIGS. 2 and 3. The panel 12 includes two parallel, spaced apart, rectangular glass panes 13*a*, 13*b*, and a spacer gasket 15 disposed around the perimeter of the panes between the edge portions of their inwardly directed faces. This glazing construction is particularly suited for thermal insulation, although other types of glazing may be used within the scope of the invention.

Figure 4:
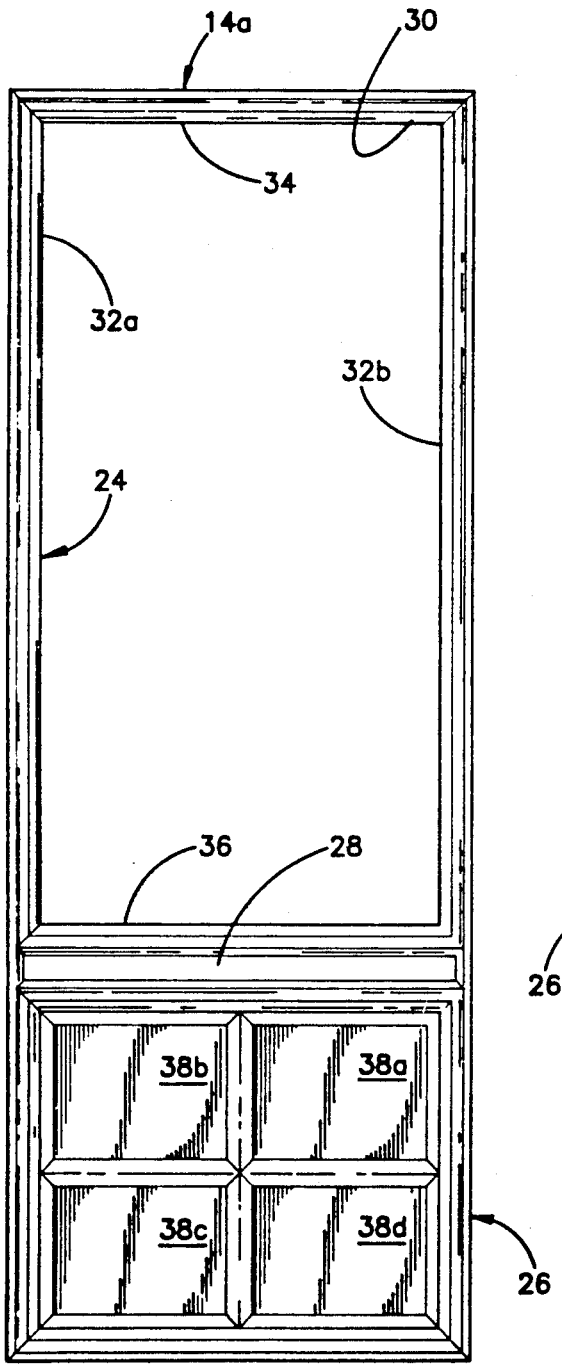
FIG. 4 is a front elevational view of a front facing.
Figure 5:
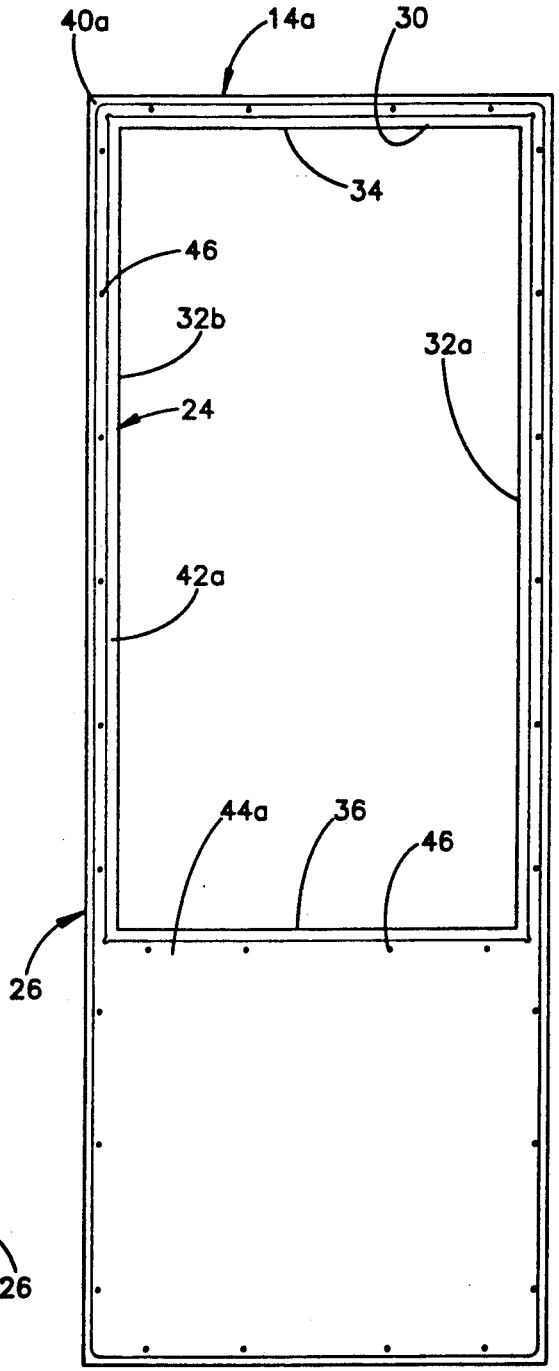
FIG. 5 is a rear elevational view of the front facing.
Figure 6:
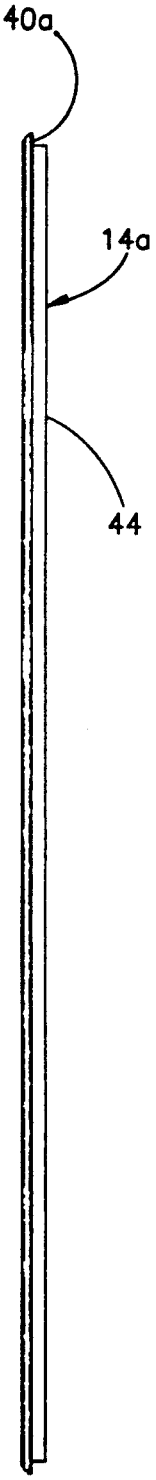
FIG. 6 is a side elevational view of the front facing.
Figure 7:
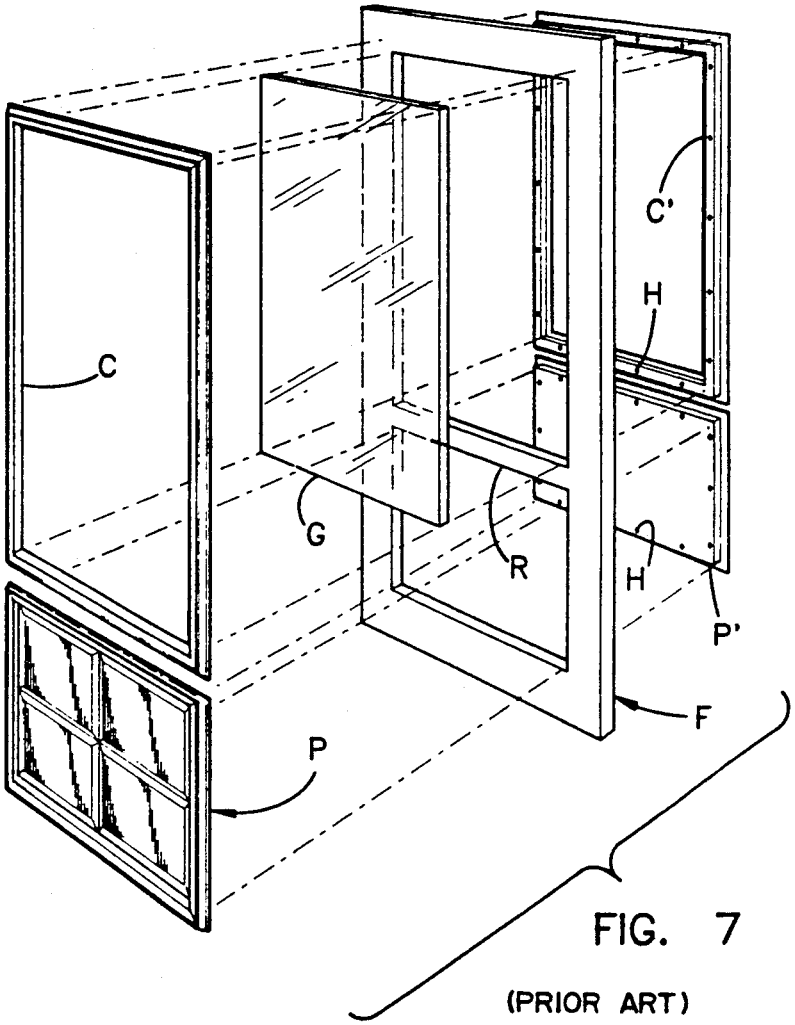
FIG. 7 (PRIOR ART)
FIG. 7 is an exploded perspective view illustrating a door having an upper light and a lower plant panel constructed according to the prior art.

Referring to FIGS. 4, 5, and 6, details of the construction of front facing 14*a* may be seen. Rear facing 14*b*, is substantially identical to front facing 14*a* except for the arrangement of the screw holes as more fully described below. Facing 14*a* is formed as an integral, unitary component. Advantageously, facing 14*a* may be made of a molded plastic material, although other suitable materials may be employed. The upper portion of the facing forms a door light casing 24, and the lower portion of the facing forms a plant panel 26. Between the casing and plant panel portions of the facing there is a horizontal planar band 28 simulative of the appearance of a door rail such as rail R of FIG. 7. This rail, however, is optional.

The door light casing 24 portion of the facing includes a rectangular opening 30 bounded on the lateral sides by spaced apart, parallel, generally vertical casing side elements 32*a*, 32*b*, on the top by casing top element 34 extending generally horizontally between the upper ends of the side elements 32*a*, 32*b*, and on the bottom by casing bottom element 36 extending generally horizontally between the lower ends of the side elements. Bottom element 36 is contiguous with the upper extent of the rail band 28, or of the plant panel 26 if no rail band is present.

The front surface of the facing is configured to present the appearance of traditional woodwork. Accordingly, the elements 32*a*, 32*b*, 34, and 36 of the casing 34 and the perimeter of the plant panel 26 are shaped to resemble wood moldings. The central portion of the plant panel 26 is configured as four raised panels 38*a*-38*d*. A wide variety of other decorative styles may be employed.

As shown in FIGS. 5 and 6, the outer perimeter of the rear of the front facing 14*a* is recessed, thus forming an outer lip 40*a*. The inner perimeter of the casing portion 24 surrounding the light opening 30 is similarly recessed, thus forming an inner lip 42*a*. The remainder of the rear surface 44*a* thus protrudes outwardly beyond the lips 40*a* and 42*a*. A series of spaced apart bores 46 (FIG. 5) are provided around the outer perimeter of the rear surface of 44*a* and across the upper portion of the plant panel portion 26 along the bottom element 36 of the casing portion.

As mentioned above, rear facing 14*b* is substantially identical to front facing 14*a*. However, as shown in FIGS. 2 and 3, rear facing 14*b* is provided with countersunk holes 48 disposed in correspondence with the bores 46 of the front facing.

Referring to FIGS. 2 and 3, details of the assembled door construction of the invention may be seen. FIG. 2 shows the cooperation of the outer lips 40*a*, 40*b* of front and rear facings 14*a*, 14*b*, to form an outer groove or recess 52 therebetween in which the inner perimeter portion of the frame 11 is received between the outer lips 40*a*, 40*b*. The inner lips 42*a*, 42*b*, similarly cooperate to form an inner groove or recess 54 and receive the outer perimeter of the glazing panel 12. Thus, the unitary facings have shorter overall horizontal and vertical dimensions than the peripheral frame such that only the inner peripheral margin of the frame is clamped in the recess 52 with the remainder of peripheral frame extending beyond the facing in all directions.

FIG. 3 shows a section of the assembled door construction adjacent the upper edge of the rail band 28 or plant panel 26. With both sections, it may be seen that the rear surfaces 44*a*, 44*b*, extend inwardly into the opening of the door frame 11. Readily installed and removed fasteners such as screws 58 are inserted through the holes 48 formed in the rear facing 14*b* and into the bores formed in the front facing 14*a*. When tightened, the screws impose a clamping force, thus capturing the glazing panel 12 and the frame 11 between the facings and providing a sturdy, easily assembled, and perfectly aligned door.

It is to be understood that other door shapes and configurations, such as having semicircular top edges or elliptical lights, may be employed within the scope of the invention. Simulated muntin strips may also be provided in the light opening of the facings.

The above description is that of a preferred embodiment of the invention. Various alterations and changes can be made without departing from the spirit and broader aspects of the invention as set forth in the appended claims, which are to be interpreted in accordance with the principles of patent law, including the Doctrine of Equivalents.

The embodiments of the invention in which an exclusive property or privilege is claimed are defined as follows:

1. A door construction comprising:

a single peripheral frame having front and rear faces and a central opening;

a first unitary facing carried on said front face of said frame disposed in correspondence with said frame central opening;

a second unitary facing carried on said rear face of said peripheral frame disposed in correspondence with said frame central opening in back-to-back relationship with said first facing, the inner peripheral margin of said peripheral frame being clamped between said facings;

each of said first and second facings including a plant panel portion and a door light casing portion, said frame central opening being dimensioned to receive both said plant panel portions and said door light casing portions;

each of said first and second facings having shorter horizontal and vertical dimensions than said peripheral frame such that said peripheral frame extends beyond said facings in all directions.

2. The door construction of claim 1 further comprising an outer peripheral lip formed about the outer perimeter of each of said facings, said lips cooperating to form a recess for receiving and clamping said inner peripheral margins of said frame adjacent to said frame central opening to align said structural facings with respect to said frame.

3. The door construction of claim 1 wherein said door light casing portion of each facing is formed with an opening surrounded by an inner perimeter of said casing portion, said inner perimeter being formed with an inner peripheral lip, said lips cooperating to form a recess, and further comprising a glazing panel disposed in said casing portion opening having peripheral edge portions received in said inner peripheral recess clamped between said lips.

4. The door construction of claim 1 wherein said door light casing portion comprises first and second spaced apart lateral side elements having upper and lower ends and a top element extending between said upper ends.

5. The door construction of claim 4 wherein said door light casing portion further comprises a bottom element extending between said lower ends, said bottom element being contiguous with the upper extent of said plant panel portion.

6. The door construction of claim 1 further comprising a glazing panel carried between the door light casing portions of said first and second facings.

7. The door construction of claim 6 further comprising means for fastening said first and second facings together in clamping relationship with said door frame and said glazing panel.

8. The door construction of claim 7 wherein said means for fastening comprises a plurality of fasteners disposed at intervals along the outer perimeter of said facings and along the lower extend of said door light casing portion.

9. In a door construction having a peripheral frame, a door light, and a plant panel, the improvement comprising:

said peripheral frame formed with a central opening, said opening being substantially coextensive with said door light and said plant panel;

said door light casing and a plant panel formed as a pair of unitary facings carried in coaligned back-to-back relationship on said peripheral frame, said facings including outer peripheral lips engaging the inner peripheral margin of said peripheral frame in clamping relationship, the outer horizontal and vertical dimensions of said peripheral frame being greater than the outer horizontal and vertical dimensions of said facings such that said peripheral frame extends beyond said facings in all directions.

10. The improvement of claim 9 wherein said each of said facings further includes a portion simulative of a door rail disposed between said door light casing and said plant panel.

11. A door construction comprising:

a peripheral frame having front and rear faces, spaced apart, generally vertically extending side portions, spaced apart, generally horizontally extending top and bottom portions, and a single central opening defined by said side, top and bottom portions;

front and rear facings carried back-to-back on said peripheral frame in cooperative alignment with each other and with said frame central opening, each of said facings, formed as a unitary element including an upper portion comprising a door light casing surrounding an opening formed therethrough, a lower portion comprising a plant panel, an outer lip formed about the outer perimeter of the facing and an inner lip formed about the inner perimeter of the facing, said outer lips of the facings cooperating to form a recess in which the inner peripheral margin of said frame is received and clamped, said peripheral frame extending outwardly beyond said facings in all directions, the rear surfaces of said facings disposed extending within said central opening thereby aligning said facings with said frame; and a glazing panel carried between said facings in alignment with said facing upper portions, said inner lips cooperating to form a recess in which the outer peripheral portion of said glazing panel is received and clamped.

12. The door construction of claim 11 wherein said facings each further include a portion simulative of a door rail disposed generally horizontally between said upper and lower portions.

13. The door construction of claim 11 further comprising a plurality of fasteners holding said facings together in clamping relationship disposed spaced apart about the outer perimeter of said facings and adjacent to the upper portion of said plant panels.

* * * * *

UNITED STATES PATENT AND TRADEMARK OFFICE

CERTIFICATE OF CORRECTION

PATENT NO. : 5,105,597

DATED : April 21, 1992

INVENTOR(S) : Steven R. Wilkening

It is certified that error appears in the above-identified patent and that said Letters Patent is hereby corrected as shown below:

Column 5, line 22:
"extend" should be --extent--.

Column 6, line 12:
delete "," after --facings--.

Signed and Sealed this

Sixth Day of July, 1993

*Attest:*

Michael K. Kirk

MICHAEL K. KIRK

*Attesting Officer*

*Acting Commissioner of Patents and Trademarks*